United States Patent [19]

Roberson, Sr. et al.

[11] 4,220,110

[45] Sep. 2, 1980

[54] UNDERWATER PROPULSION UNIT

[76] Inventors: James E. Roberson, Sr.; James E. Roberson, Jr., both of 212 Seneca Dr., Forest Heights, Md. 20021

[21] Appl. No.: 901,677

[22] Filed: May 1, 1978

[51] Int. Cl.[2] ..... A63B 35/12

[52] U.S. Cl. ..... 114/315; 440/5; 440/113

[58] Field of Search ..... 115/6.1; 114/315; 9/301; 60/407, 412, 413, 415, 456; 184/55 A, 58

[56] References Cited

U.S. PATENT DOCUMENTS

| | | | |
|---|---|---|---|
| 2,509,942 | 5/1950 | Sanford | 60/415 X |
| 2,864,464 | 12/1958 | Booth | 184/55 A |
| 3,016,020 | 1/1962 | Rineer | 60/413 X |
| 3,128,739 | 4/1964 | Schultz | 115/6.1 |
| 3,393,770 | 7/1968 | Fertik et al. | 184/58 X |
| 3,400,680 | 9/1968 | Taylor | 114/315 |
| 3,430,602 | 3/1969 | Greiner | 115/6.1 |
| 3,957,007 | 5/1976 | Thomas | 115/6.1 X |

*Primary Examiner*—Sherman D. Basinger
*Attorney, Agent, or Firm*—Pollock, Vande Sande & Priddy

[57] ABSTRACT

A self-contained unit for underwater propulsion, for use with scuba tanks. The unit comprises an hydraulic motor which uses a special air compressor oil as an hydraulic fluid and uses the breathing medium to circulate the oil uniformly mixed therewith the mixture being powered by the breathing air supply itself and later separated, the air being then filtered for use as breathing medium by the diver.

7 Claims, 3 Drawing Figures

FIG. 1
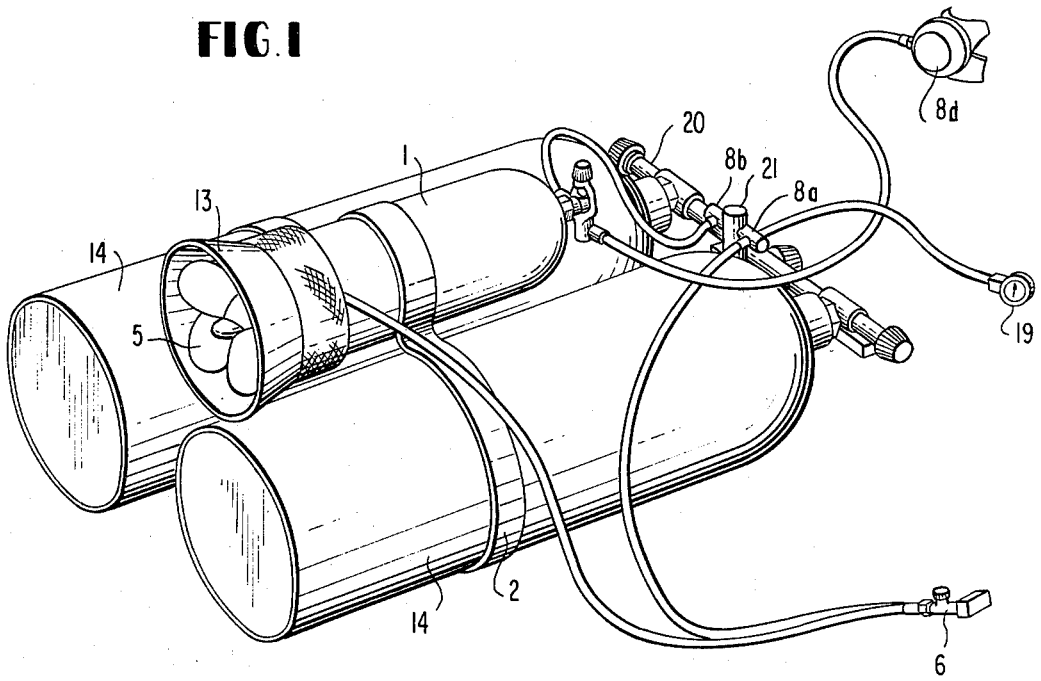
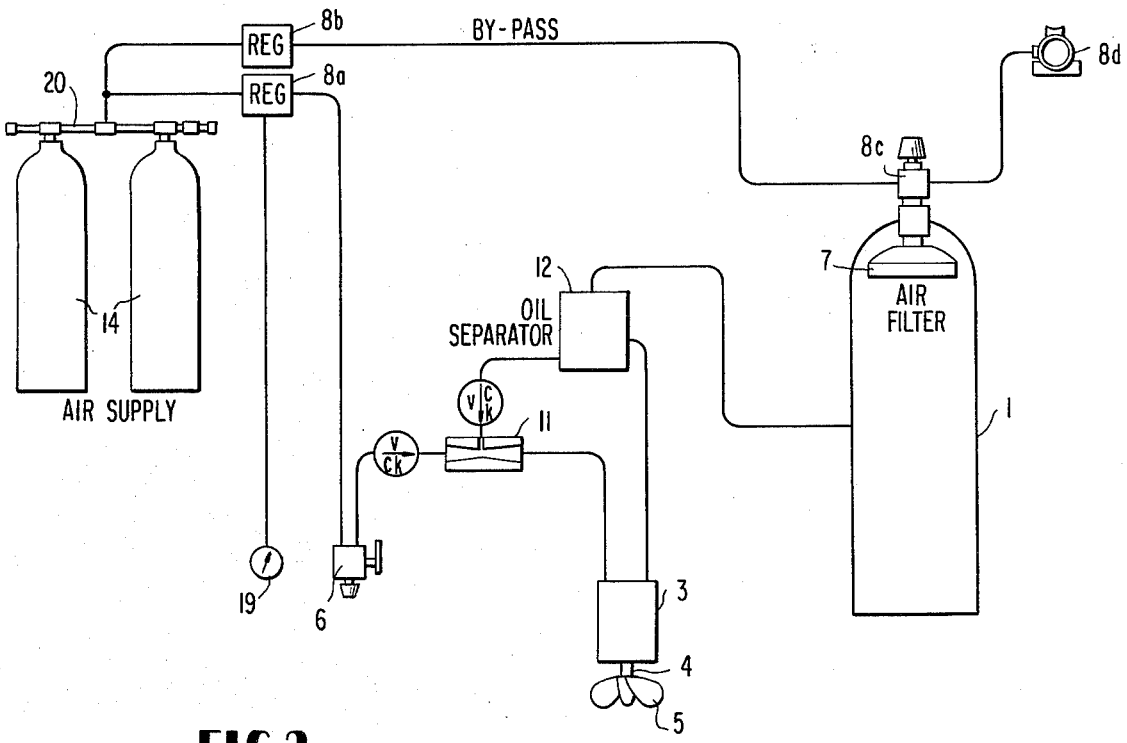
FIG. 2

UNDERWATER PROPULSION UNIT

BACKGROUND OF THE INVENTION

The need for apparatus permitting underwater propulsion without undue effort on the part of the diver has long been recognized. Unfortunately, the achievement of this objective has in the past required heavy and cumbersome equipment, including large quantities of batteries, which are costly and require frequent maintenance and replacement (see, e.g., Strader U.S. Pat. No. 3,329,118 and Keogh-Dwyer U.S. Pat. No. 2,722,021). In addition, buoyancy control devices were needed, capable of supporting this equipment as well as the diver himself, thus adding further to the size and weight of the apparatus.

Other prior art devices are disclosed in Rosenberg U.S. Pat. No. 3,084,654 (gas-driven piston motor working on the theory of isothermal expansion) and Oversmith U.S. Pat. No. 3,420,202 (float-supported craft with combustion engine fed by compressed air supply).

It has long been recognized that the breathing air carried by scuba divers represents a source of potential power which is actually capable of propelling a diver for a greater length of time than it would take the diver to consume the air by breathing it. Up to the present, however, it has never appeared to be practical to convert this energy by pneumatic means for purposes of propulsion.

BRIEF SUMMARY OF THE INVENTION

It is the object of this invention to provide an underwater propulsion unit which is of compact size, light in weight, easily attachable and removable, and capable of increasing the efficiency, maneuverability, mobility, speed and range of divers, and which permits all the air used to power the motor to be breathed by the diver.

This object is accomplished by powering the propulsion unit directly or indirectly by the air or gas mixture breathed by the diver, combined with a suitable oil uniformly mixed therewith. A breathing by-pass circuit is provided, so that the diver will have ample breathing air even when the propulsion unit is not in operation, e.g., during malfunctioning.

BRIEF INTRODUCTION TO THE DRAWINGS

In order that the invention may be more clearly understood, reference will now be made to the accompanying drawings, wherein several embodiments of the invention are shown for purposes of illustration, and wherein:

FIG. 1 is a perspective view of the propulsion unit according to the invention, mounted on twin scuba tanks;

FIG. 2 is a flow diagram showing the path of the breathing medium during normal operation and during non-operation of the propulsion unit;

DESCRIPTION OF PREFERRED EMBODIMENT

Figure 3:
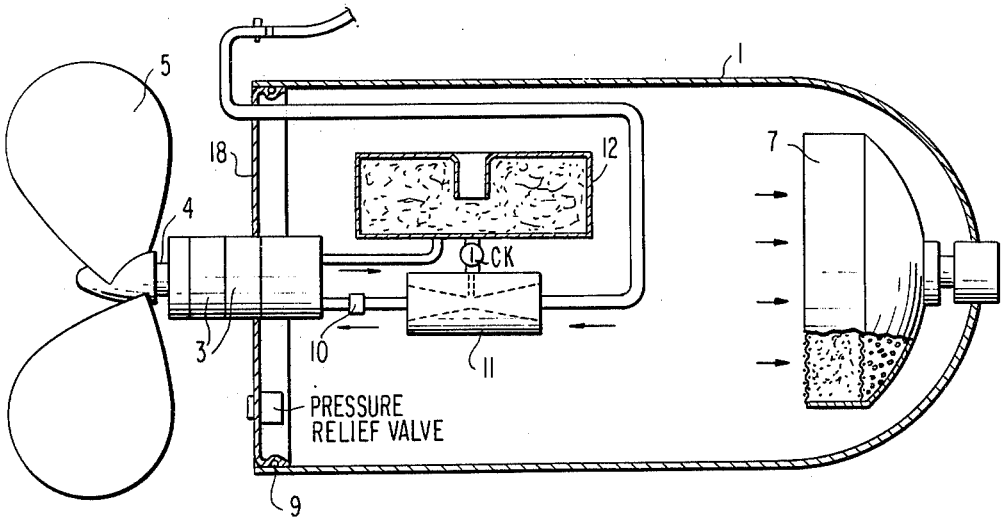
FIG. 3 is a longitudinal section through the propulsion unit according to the invention.

The propulsion unit according to the invention comprises a housing 1 in the nature of a pressure vessel. This housing can, if desired, be mounted on one or more conventional scuba tanks 14 normally connected by a yoke 20, by standard mounting means 2, e.g., stainless steel straps pre-formed to fit standard size tanks. It may be attached to apparatus, e.g., photographic apparatus, controlled by the diver. The weight of the device is less than that of the average weight belt worn by scuba divers.

Contained at least partly within the housing is the propulsion means comprising a positive displacement hydraulic motor 3 having a drive shaft 4 with a propeller 5 mounted thereon. As shown in FIG. 1, propeller 5 is protected by a shroud 13. Moreover, to prevent the escape of breathing medium, the end portion of the housing 1 surrounding motor 3 is sealed by a back plate motor mounting wall 18, provided with a seal 9 and a pressure relief safety valve (FIG. 3).

Air input to the motor is controlled by valve 6 which, as shown in FIG. 2, is provided with a go/no go control lever. After entry into housing 1, the air passes through an oil injector 11 provided with a venturi system. Arranged above oil injector 11 within housing 1 is an oil separator 12. The oil and air mixture passes through a filter 10 adjacent the input to motor 3, and after emerging from the low-pressure output side of the motor, is piped into container 12 on the surface of which the oil collects and drains down into oil injector 11, whence the cycle is repeated. The output for oil is thus at the bottom and the output for air in the center section. The amount of oil to be placed into the system initially will be about one-half the volume of the oil separator. The oil must be a base stock naphthenic mineral oil and meet or exceed Mil. Spec. L 17672, oil for breathing air compressors or the equivalent. The oil is circulated by means of the air.

It should be explained that the invention results essentially from the transfer of energy from one form to another at a much higher pressure than is necessary to do a given job. By this technique, the energy extracted from one form is directly added back to the remaining energy in the first form. The result is an apparent modification to the pressure/volume relationship by the addition of a fluid.

Since fluids of a viscosity suitable for lubrication make specification of dimension for venturi orifices uncertain, the oil injector may include an oil pump, which may, e.g., be driven from the main shaft of the propelling motor or by a supplemental air-operated hydraulic pump.

After passing through oil separator 12, the air is released into the housing and passed through filter 7, which purifies it for breathing before it is permitted to pass out of the housing through a "K" or stem valve.

Regulators for regulating the pressure of the breathing medium are shown at 8*a*, 8*b*, 8*c* and 8*d*. Regulators 8*a* and 8*b* are preferably a unit having two individually adjustable primary stages. These may comprise a regulator manifold mounted on post 21 (FIG. 1). However, regulators presently in use may be modified for use in the system according to the invention, by appropriate setting of pressures. A conventional pressure gauge 19 is also provided.

It is important to note that the pressure within housing 1 should never exceed that of the setting of the high side of regulator 8*a*. In the event of such a build-up of excessive pressure, a safety blow-off or pressure relief valve is provided, as indicated in FIG. 3.

Considering now the by-pass arrangement shown in FIG. 2, it will be noted that the "K" or stem valve used as the output for the housing will be provided with a gauge port. This gauge port will be modified, and a hose from the first stage regulator low pressure side will be inserted, so that air coming from the air source through the by-pass may be breathed directly by the diver, as indicated at 8*d*. It will be obvious that the pressures may be varied to suit individual needs and circumstances, and to meet the requirements of the particular type of regulator which is used.

In designing the unit for use by divers, it will be advantageous to set the maximum propulsion speed obtained at about one half the maximum speed endurable by humans in an underwater environment, thereby assuring that the said maximum speed can be approached with but moderate physical exertion on the part of the diver.

It will be obvious that many advantages are obtained by use of the present invention. In the first place, where underwater work is to be performed, the propulsion effort saved by use of the invention can be utilized in performing the work itself. Since more ground can be covered without additional expenditure of effort, less of the available air supply is used up per unit of distance, with the result of longer available dive time.

Since the device is powered by breathing air, it can be constructed of non-magnetic materials, with obvious advantages for certain strategic uses. A further advantage for such uses is the fact that the exhaust of the air-driven motor is captured and muffled within the confines of the system, so that it is barely audible even to the diver himself. Finally, because of its propulsion by breathing air, the speed of the unit can be preset by the diver and operated without use of his hands, which are therefore free for exploratory activities, photography, etc.

In designing the housing, consideration must be given not only to the interior components, but also to the amount of air it must hold as ballast. If the housing is too small, the speed of the drive motor will vary markedly due to the pressure drop as each breath is inhaled. It has been found that a volume of about one cubic-foot at atmospheric pressure provides a suitable operating pressure for a unit of desirable dimensions.

What is claimed is:

1. A self-contained underwater propulsion unit for use in combination with a breathing medium supply means, comprising (a) a housing comprising a pressure vessel and having inlet and outlet ends;

(b) means for mounting said housing for use by a diver;

(c) propulsion means comprising an hydraulic motor means having a drive shaft with a propeller thereon;

(d) means for supplying and removing approved breathing air compressor oil for said hydraulic motor;

(e) means for controlling breathing medium to said hydraulic motor means, wherein said breathing medium is used to circulate said compressor oil;

(f) filter means adjacent the outlet end of said housing; and (g) means for regulating the pressure of said breathing medium.

2. A propulsion unit according to claim 1, wherein said housing is mounted on equipment controlled by the diver.

3. A propulsion unit according to claim 1, including sealing means for obstructing the escape of breathing medium from said housing.

4. A propulsion unit according to claim 1, including second filter means adjacent the input to said motor means.

5. A propulsion unit according to claim 1, including a plurality of motors.

6. A propulsion unit according to claim 1, wherein said pressure regulating means is adapted for supplying multiple outputs at first and second pressures.

7. A propulsion unit according to claim 1, wherein said pressure regulating means is adapted for supplying output to a diver for breathing.

* * * * *